US005345509A

United States Patent [19]

Hofer et al.

[11] Patent Number: 5,345,509

[45] Date of Patent: Sep. 6, 1994

[54] TRANSDUCER WITH EAR CANAL PICKUP

[75] Inventors: Alan Hofer, Wantagh, N.Y.; Peter Untersander, Ecoteaux, Switzerland

[73] Assignee: Stanton Magnetics, Inc., Plainview, N.Y.

[21] Appl. No.: 924,893

[22] Filed: Aug. 4, 1992

[51] Int. Cl.[5] ..... H04R 25/00

[52] U.S. Cl. ..... 381/68.6; 381/68.3; 381/151

[58] Field of Search ..... 381/151, 68.3, 68.6, 381/169, 163, 205, 155, 183, 187, 94

[56] References Cited

U.S. PATENT DOCUMENTS

| | | | |
|---|---|---|---|
| 2,535,063 | 12/1950 | Halstead | 381/111 |
| 4,323,999 | 4/1982 | Yoshizawa et al. | 381/151 |
| 4,334,315 | 6/1982 | Ono et al. | 381/151 |
| 4,532,649 | 7/1985 | Bellafiore | 381/68.6 |
| 4,696,045 | 7/1987 | Rosenthal | 381/151 |
| 4,843,628 | 6/1989 | Hofer | 381/151 |
| 4,985,925 | 1/1991 | Langberg et al. | 381/72 |

FOREIGN PATENT DOCUMENTS

| | | | |
|---|---|---|---|
| 0088996 | 5/1983 | Japan | 381/151 |
| 0103798 | 6/1985 | Japan | 381/151 |

*Primary Examiner*—Curtis Kuntz
*Assistant Examiner*—Huyen D. Le
*Attorney, Agent, or Firm*—Kane, Dalsimer, Sullivan, Kurucz, Levy, Eisele and Richard

[57] ABSTRACT

A transducer assembly includes a bi-directional transducer coupled to an ear mold for transmitting and receiving sounds from a remote location. A by-pass channel is provided in the ear mold for ambient sounds which by-pass the transducer.

12 Claims, 2 Drawing Sheets

TRANSDUCER WITH EAR CANAL PICKUP

BACKGROUND OF THE INVENTION

A. Field of Invention

This invention pertains to a transducer assembly for both generating and reproducing sounds and more particularly to a transducer assembly adapted for placing in or adjacent to a wearer's ear.

B. Description of the Prior Art

People performing certain tasks require instant or continuous communication means for exchanging information with others. It has been customary to provide for these people headsets consisting of a speaker disposed adjacent to a person's ear and a separate microphone near the mouth. However, because of their size and weight these head sets are uncomfortable to wear and may interfere with the person wearing them. In addition, in certain situations, a person may not wish not use a head set openly.

In view of the above mentioned problems with the prior art, it is an objective of the present invention to provide a transducer assembly which can be positioned to pick up sounds generated by the person and transmit sounds to the person when said transducer assembly is positioned near the ear.

A further objective is to provide a small efficient transducer which can be fit into or attached to a person's ear.

Yet another objective is to provide a bi-directional transducer assembly which also permits extraneous sounds to be heard. Other objectives and advantages of the invention shall become apparent from the following description.

SUMMARY OF THE INVENTION

A transducer assembly constructed in accordance with this invention includes a bi-directional transducer coupled to an ear mold for exchanging sound waves. A bypass channel is provided in the ear mold for ambient sounds bypassing the transducer. In one embodiment the transducer is mounted directly to the ear mold.

In another embodiment, the transducer is mounted separately, for example on a helmet and is coupled to the ear mold through biased contact means.

DETAILED DESCRIPTION OF THE INVENTION

Figure 1:
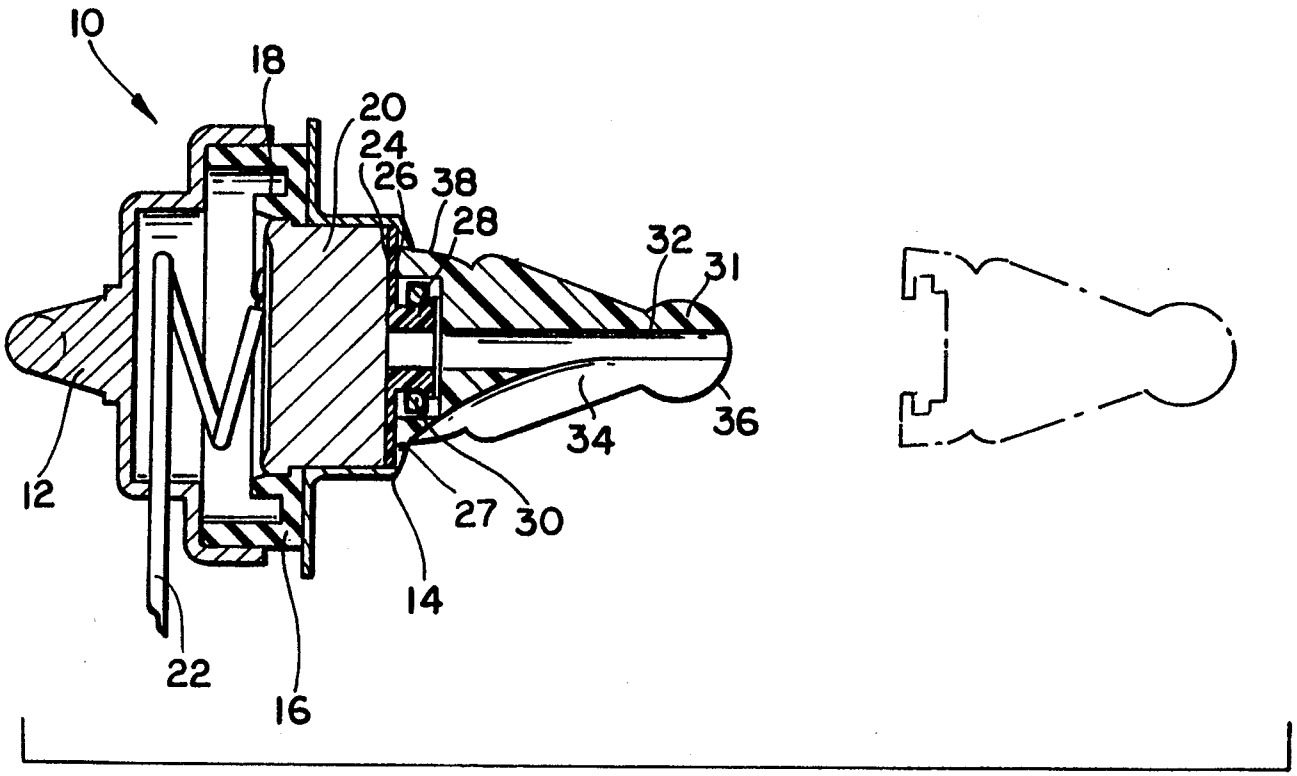
FIG. 1 shows a cross sectional view of a transducer constructed in accordance with the present invention.

Referring now to the drawings, FIG. 1 shows a transducer assembly 10 including a housing consisting of a cup 12 and a dome 14. These two members are held together by an annular elastomeric sleeve 16. Sleeve 16 extends inwardly and has a cylindrical wall 18 for holding a transducer 20. Preferably transducer 20 is an inertial bi-directional transducer having a dual function as described below. Transducer 20 is connected by a cable 22 to a power supply and control circuitry (not shown). When the transducer is in intimate contact with a solid member, it receives sound waves propagating through that member and transforms the sound waves into corresponding electrical signals output on cable 22. Alternatively, electrical signals received by the transducer on cable 22 are transformed into sound waves by the transducer 20. A transducer of this type is disclosed in commonly assigned U.S. Pat. No. 4,843,628.

On one side, transducer 20 has a wall 24. Attached to wall 24 is an annular plate 26 which acts as a sound board to amplify the sounds generated by transducer 20.

Adjacent to plate 26, dome 14 is provided with a circular opening 27. A plastic ring 28 is attached by welding, gluing or other well known means to wall 24, concentrically with opening 27. Ring 28 is provided with a retaining spring 30 and is shaped and sized to mate with a standard hearing mold.

The transducer assembly 10 also includes an ear mold 31 made of a plastic material. This mold is formed to fit a person's ear. The mold 31 has two channels: a central channel 32 which extends co-axially through the mold, and a by-pass channel 34 which starts from the distal end 36 of mold 31 and angles off so that it terminates outside the mold crown 38. Mold crown 38 is sized and shaped so that it snaps over ring 28.

The transducer assembly 10 operates as follows. A person inserts the ear mold 31 into his ear positioning it so that the mold contacts the mastoid bone. Once the assembly is properly positioned, the person could speak at a low volume, or even sub-vocalize. The sounds thus produced travel through his mastoid bone and the ear mold 31 to plate 26 and ring 28. The sounds are then transformed into corresponding electrical signals by transducer 20 and transmitted over cable 22. Similarly, signals received through cable 22 are transformed into sounds by transducer 20. After amplification by plate 26, they are transmitted to the ear through central channel 32. Importantly, ambient sounds are also easily heard by the user because they travel through by bypass channel 34 to the ear.

After use, the mold is easily separated from the assembly housing (as shown in dotted lines in FIG. 1) for cleaning.

Figure 2:
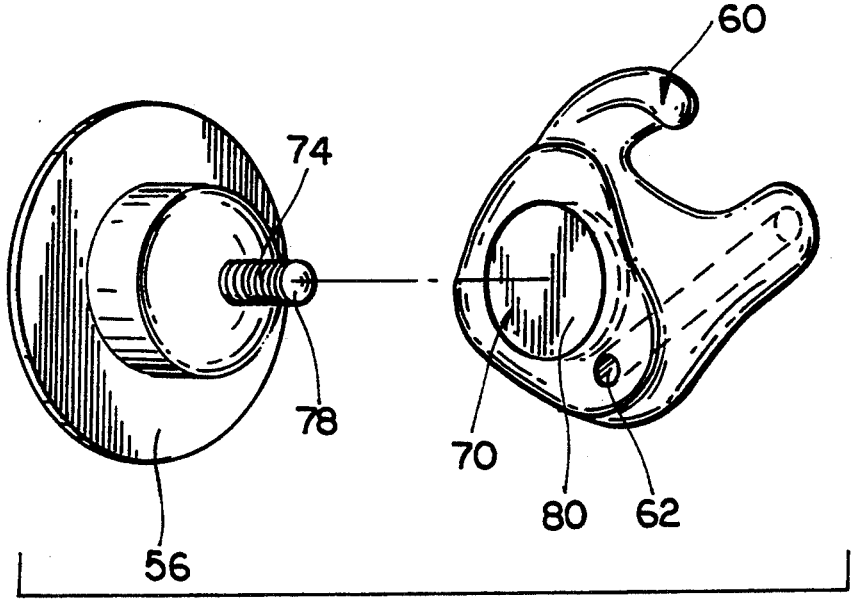
FIG. 2 shows an isometric view of an alternate embodiment.
Figure 3:
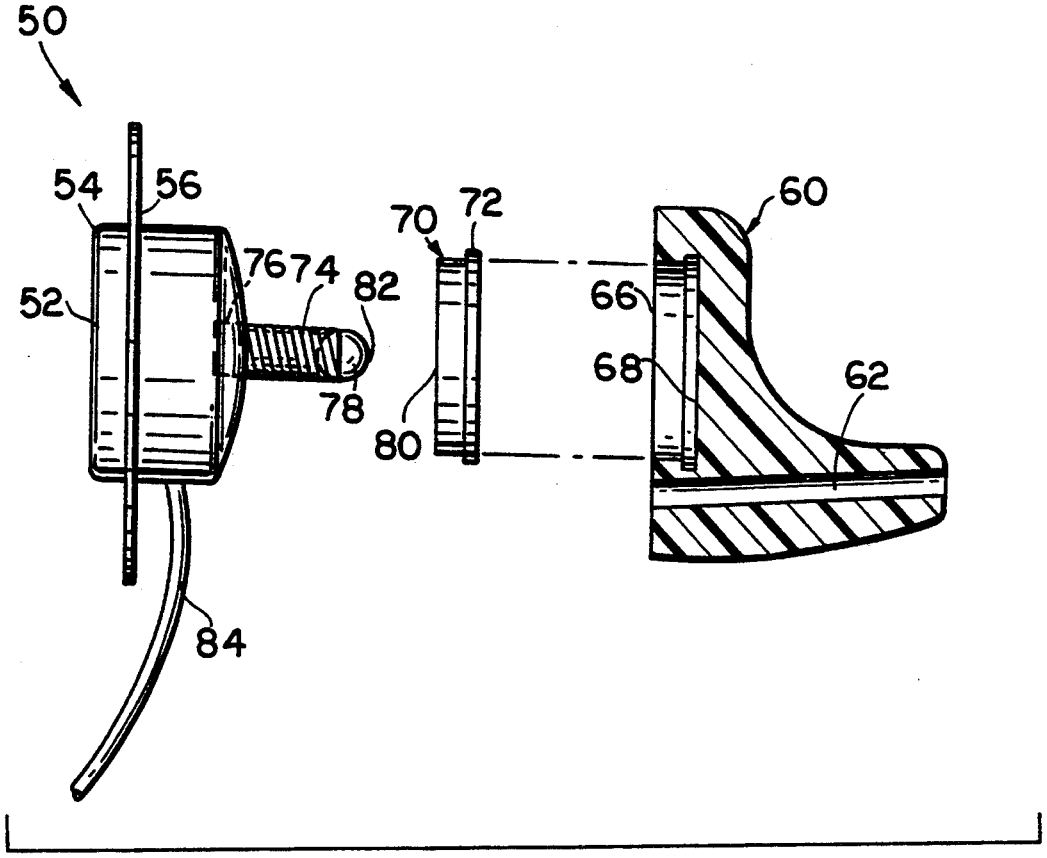
FIG. 3 shows a partial cross-sectional view of the embodiment of FIG. 2.

The transducer assembly shown in FIG. 1 is preferably worn in the ear when the transducer is not obstructed. An alternate embodiment is shown in FIGS. 2 and 3 of a transducer assembly which can be incorporated into and worn with a head protective device such as a helmet. This embodiment is more suitable for use by peacekeeping personnel such as police on patrol, etc. In this embodiment a transducer assembly 40 is provided having an inertial transducer 52 disposed in a cylindrical housing 54. Preferably housing 54 is provided with a peripheral flange 56 used for mounting the transducer 52 on a helmet or other protective gear disposed on a person's head.

Assembly 50 further includes an ear mold 60 made of a plastic material and including an acoustic channel 62 extending through the length of the mold 60. Mold 60 is further provided with a substantially disk-shaped depression 66 having an enlarged portion 68.

A magnetic contact plate 70 is also provided with a backing member 72. Plate 70 is disposed in cavity 66 with backing member 72 extending into the enlarged section 68 to maintain the plate in position, as shown in FIG. 3. Plate 70 may be made for example of samarium cobalt to provide a high intensity magnet field.

A spring 74 is secured within an axial cavity 76 of transducer. A magnetic ball 78 is attached to the distal end of spring 74 as shown.

Normally the transducer is mounted for example inside a helmet by flange 56 while mold 60 with plate 70 is placed in an ear. The spring has a length selected so that when the helmet is placed in position over the head, ball extends to and is biased against plate 72. Plate 70 has a contacting surface 80 while ball 78 has a contacting point 82. The biasing force on the ball is increased by magnetizing the ball 78 and plate 70 in a manner that surface 80 and point 82 have opposite polarities thereby generating a magnetic force therebetween. As a result, a positive contact is maintained between the transducer and plate 70 through spring 74 and ball 78 even when the helmet is shaken considerably.

The transducer assembly 50 of FIGS. 2 and 3 operates in a manner similar to the assembly of FIG. 1. Electrical signals received by transducer 52 over cable 84 are converted into sound waves which propagate from housing 54 through spring 74, ball 78, and plate 66 to the wearer's ear. If necessary, member 68 may be dimensioned to act as a sound board amplifying the sounds.

Sounds made by the wearer propagate through the mastoid bone, mold 60, plate 66, ball 78 and spring 74 to the transducer 52 where they are converted into electrical signals.

Ambient sounds are heard by the person through channel 62.

Importantly, in both embodiments, since the received (by air) and transmitted (by bone conduction) sounds propagate along different transmission paths, there is no interference between them.

Obviously, numerous modifications could be made to this invention without departing from its scope as defined in the appended claims.

I claim:

1. A transducer assembly comprising:

a bi-directional transducer;

ear mold means constructed and arranged to fit into a person's ear, said ear mold means cooperating with said bi-directional transducer to propagate sound waves between said bi-directional transducer and said ear, said ear mold means further including bypass path means for defining a path for ambient sounds bypassing said bi-directional transducer; and coupling means for coupling said bi-directional transducer to said ear mold means.

2. The transducer assembly of claim 1 wherein said bi-directional transducer is mounted on said ear mold means.

3. The transducer assembly of claim 1 wherein said coupling means comprises a contacting member and a biasing member for biasing said contacting member between said ear mold means and said transducer.

4. The transducer assembly of claim 1 wherein said bi-directional transducer is an inertial transducer.

5. A transducer assembly for converting electrical signals onto sound and sounds into electrical signals, said transducer assembly comprising:

a bi-directional transducer;

a transducer housing for holding said bi-directional transducer;

ear mold means arranged and constructed for insertion into a person's ear in contact with a mastoid bone for exchanging sound waves between said bi-directional transducer and said mastoid bone;

a by-pass channel for directing ambient sounds to said ear bypassing said bi-directional transducer; and coupling means for coupling said ear mold means and said transducer housing.

6. The transducer assembly of claim 5 wherein said coupling means includes a first coupling member mounted on said transducer housing and a second coupling mounted on said ear mold said first and second coupling members cooperating for mounting said transducer housing on said ear mold.

7. The transducer assembly of claim 6 wherein said ear mold includes a first channel leading to said bi-directional transducer for directing sounds from said bi-directional transducer to said ear.

8. The transducer assembly of claim 5 wherein said transducer housing includes mounting means for mounting said bi-directional transducer separately from said ear mold.

9. The transducer assembly of claim 8 further comprising a contact means and biasing means for biasing said contact means between said ear mold and said bi-directional transducer.

10. The transducer of claim 9 wherein said contact means includes a plate mounted on said ear mold, and a contact member in contact with said plate.

11. The transducer of claim 10 wherein said biasing means includes a spring extending outwardly of said transducer housing for biasing said contact member against said plate.

12. The transducer of claim 10 wherein at least one of said contact plate and contact member are made of a magnetic material.

* * * * *